United States Patent [19]

Ayub

[11] Patent Number: 4,805,694

[45] Date of Patent: Feb. 21, 1989

[54] HEAT EXCHANGER

[75] Inventor: Zahid H. Ayub, Constantine, Mich.

[73] Assignee: E. L. Nickell, Co., Inc., Constantine, Mich.

[21] Appl. No.: 125,194

[22] Filed: Nov. 25, 1987

[51] Int. Cl.[4] ..... F28F 9/02

[52] U.S. Cl. ..... 165/158; 165/174

[58] Field of Search ..... 165/158, 174, 147, 159, 165/172, 173; 52/518

[56] References Cited

U.S. PATENT DOCUMENTS

| | | | |
|---|---|---|---|
| 1,813,234 | 7/1931 | Dodd . | |
| 2,596,195 | 5/1952 | Arbuckle | 165/176 |
| 3,048,372 | 8/1962 | Newton, Jr. | 257/236 |
| 3,527,290 | 9/1970 | Lossing | 165/70 |
| 3,800,867 | 4/1974 | MacKenzie | 165/97 |
| 3,802,496 | 4/1974 | Ris et al. | 165/174 X |

FOREIGN PATENT DOCUMENTS

| | | | |
|---|---|---|---|
| 558510 | 1/1975 | Switzerland | 165/174 |

*Primary Examiner*—Margaret A. Focarino

*Attorney, Agent, or Firm*—Jeffers, Hoffman & Niewyk

[57] ABSTRACT

A dry expansion heat exchanger of the tube and shell type. The heat exchanger comprises a shell having a plurality of bundles of tubes therein and a pair of end bonnets on opposite ends of the shell. Secondary baffles within the bonnets subdivide the bonnets into subchambers that are aligned with respective bundles of tubes. The cross-sectional areas of successive bundles of tubes increase to allow for expansion of the coolant as it flows through the heat exchanger and absorbs heat from the fluid to be treated. The secondary baffles define restricted flow areas for the coolant which have increasingly larger cross-sectional areas for successive chambers in the end bonnets.

14 Claims, 1 Drawing Sheet

HEAT EXCHANGER

BACKGROUND OF THE INVENTION

The present invention relates to a heat exchanger and in particular to an end bonnet for use in a shell and tube heat exchanger.

Shell and tube heat exchangers generally provide a counter or cross flow arrangement for the cooling of a first fluid in the shell body by a second or coolant fluid passing through the tubing within a shell body, which is frequently cylindrically shaped. This tubing provides communication between sealed opposite ends of the cylindrically shaped configuration and defines a flow path for communication of the cooling fluid from end to end of the shell structure. The tubes terminate at an end plate or flange at either end of the shell and bonnet is provided at either end of this shell to define a transfer chamber for fluid communication between successive sets of tubes at each end of the shell.

Heat exchangers are generally utilized for cooling various fluids, which may be either gaseous or liquid, by coolant fluid transferred through the tube arrangements. As it picks up heat from the fluid to be chilled, the coolant fluid will boil or vaporize as it flows through the tubing network extending between the bonnets. Initially during the cooling cycle, the cooling fluid is generally a liquid.

The tubes provide a tortuous path encompassing multiple passes of the coolant fluid through the shell and, as it continues to increase in temperature, the cooling fluid expands. As the cooling fluid proceeds through each successive or sequential pass, there will be a change of state for the fluid from liquid to the gaseous state. This change of state requires an expanded tube volume to accommodate the expanding cooling fluid. Therefore, subsequent cooling passes require an increased number of tubes or larger cross-sectional area tubes to transfer the initial fluid volume through the heat exchanger network of tubes. Failure to provide this increased fluid transfer volume, as the coolant fluid temperature increases until it attains the vapor state, would result in high fluid velocities in the tubes and large back pressure. In addition, problems relating to the fluid distribution result from these pressure-temperature changes.

Abrupt increases in flow areas causes large pressure drops within the heat exchanger and results in decreases in pressure and thus reduction in the boiling point of the refrigerant or cooling fluid. This characteristic indicative of a phenomenon referred to as flashing. Flashing refers to the transition from liquid to the gaseous phase due to the drop in saturation temperature. Therefore, it is desirable to limit the loss of cooling capacity due to flashing.

Bonnets of varying designs have been provided for aiding and improving fluid flow, which designs include the utilization of U-shaped return passages and inlet and outlet passages in alignment with the tubes within the housing for providing a continuous flow path through the tubes. These U-shaped passages may be provided in a flat-plate type end bonnet. However, such U-tubes are very expensive and difficult to maintain. Other prior art heat exchangers employ hemispherically shaped bonnets that are subdivided by partitions or baffle plates between the flange plates and the contoured inner surface of the bonnet. These baffle plates thus provide transfer chambers in the bonnet between successive tube bundles of the tube network. However, the abrupt increase in flow area in the bonnets causes undesirable pressure drops.

SUMMARY OF THE INVENTION

The present invention encompasses a heat exchanger of the shell and tube type with bonnets having chambers for flow reversal of a heat transfer fluid between successive tube bundles.

The bonnets incorporate primary baffles or walls which divide the hemispherical compartment into multiple chambers for fluid communication for each sequentially arranged tube bundle set. Secondary baffles are provided in each fluid transfer chamber, which secondary baffle defines a gap between its outer edge and the inner surface of the bonnet. The gap has a cross-sectional area substantially equal to the total cross-sectional area of the tube bundles upstream of and leading into the fluid transfer bonnet chamber. Thus, the fluid flowing through the tubes and into the bonnet chamber is presented with a flow restriction that is equal in cross-sectional area to the cross-sectional area of the combined tubes making up the tube bundle flowing into the chamber. This avoids the large pressure drop that results in prior art heat exchangers wherein the fluid expands rapidly into a very large volume, thereby flashing and reducing efficiency of the heat exchanger. The fluid then flows around the obstruction in the end bonnet to a second subchamber or cell which has a larger cross-sectional are than the first subchamber due to the fact that it is aligned with a larger number of tubes in the second stage of the heat exchanger. From this subchamber, the fluid is slightly restricted as it enters the second bundle of tubes, flows to the opposite end of the heat exchanger and encounters another chamber having a secondary baffle which presents a flow restriction to the fluid having a cross-sectional area substantially equal to the combined cross-sectional areas of the tubes in the second bundle.

Because the fluid is absorbing heat, it is gradually expanding and changing from liquid to gaseous state, thereby necessitating a larger number of tubes in each successive bundle. The secondary baffles are also spaced further away from the walls of the end bonnets so as to form a gap that substantially matches the cross-sectional area of the bundle of tubes flowing into the particular subchamber in question. This continues throughout the heat exchanger with the fluid flowing, on each pass, through larger numbers of tubes or bundles having larger cross-sectional areas as the fluid expands until it flows out of the heat exchanger. The invention is applicable to heat exchangers of any number of stages wherein the baffling in the end bonnets presents increasingly larger cross-sectional flow areas to the fluid as the fluid flows through tube bundles having larger cross-sectional areas.

The invention relates to a heat exchanger comprising a shell including a chamber and a plurality of bundles of tubes extending from one end of the shell to the other. A first flow reversing bonnet is mounted on one end of the shell and a second flow reversing bonnet is mounted on the other end of the shell, each of the bonnets having at least one flow reversing chamber in fluid communication with two bundles of tubes. The chambers and tubes are arranged serially along the flow path of the coolant fluid which flows through the heat exchanger whereby fluid flows from the inlet through a bundle of tubes into one chamber, then reverses direction and flows through another bundle of tubes to the next chamber, and so on until the fluid has flowed through the entire heat exchanger and exits the discharge outlet. Baffles in each of the flow reversing chambers subdivide the chamber into two subchambers, one being aligned with a bundle of tubes leading into the chamber and other being aligned with a bundle of tubes leading out of the chamber. The baffles define restricted flow areas for coolant fluid flowing form one subchamber to the next. The tube bundles aligned with successive subchambers have increasingly larger cross-sectional flow areas. The cross-sectional flow area defined by a baffle means of a particular flow reversing chamber are larger than the cross-sectional flow area defined by the baffle means of the preceding, upstream flow reversing chamber.

BRIEF DESCRIPTION OF THE DRAWINGS

In the figures of the drawing, like reference numerals identify like components and in the drawings.

DETAILED DESCRIPTION OF THE INVENTION

Figure 1:
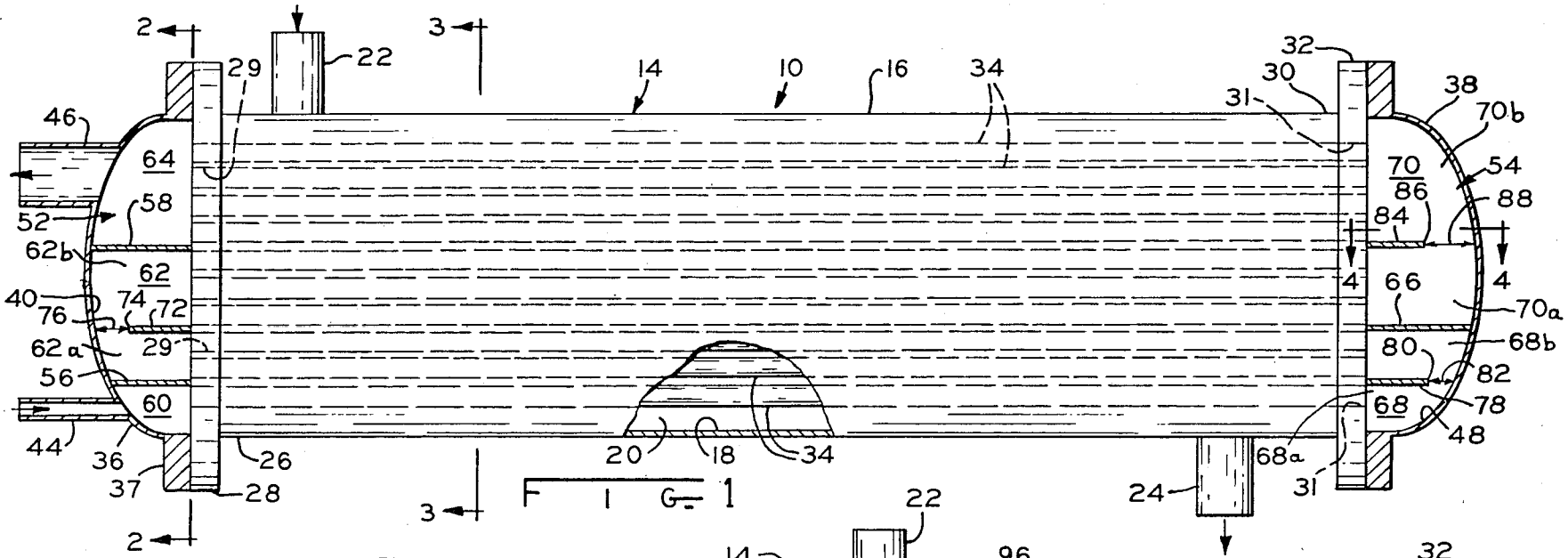
FIG. 1 is a diagrammatic elevational view of a tube and shell heat exchanger with hemispherical bonnets in cross-section.

A dry expansion tube and shell heat exchanger 10 with hemispherical end bonnets is illustrated in FIG. 1. Heat exchanger 10 includes a shell 12 with a wall 14 having an outer surface 16 and an inner surface 18, a generally cylindrically shaped chamber 20, a treatment fluid inlet port 22 through wall 14 to chamber 20, and a treatment fluid discharge port 24. Shell 12 has a first end 26 with a first flange 28, and a second end 30 with a second flange 32.

First flange 28 and second flange 32 are provided with a plurality of openings 29 and 31, respectively, in axial alignment generally parallel to the longitudinal axis of shell 12. A plurality of heat exchange fluid tubes 34 are positioned in chamber 20 and are supported at their ends in openings 29 and 31 in flanges 28 and 32, respectively.

A first bonnet 36 having flange 37 is mounted on flange 28 and secured thereto by means known in the art, such as bolts or clamps, and a second bonnet 38 having flange 39 is similarly mounted on flange 32. First bonnet 36 includes inner surface 40, coolant fluid inlet 44 and coolant fluid discharge outlet 46. Second bonnet 38 has an inner surface 48. Bonnets 36, 38 cooperate with flanges 28 and 32 to define first and second fluid transfer compartments 52 and 54, respectively. Tubes 34 communicate between compartments 52, 54.

As shown in FIG. 1, primary baffle plates 56 and 58 are disposed in compartment 52 between first flange 28 and end surface 40 of first bonnet 36 to define fluid chambers 60, 62 and 64 in bonnet 36. A similar primary baffle plate 66, which is mounted in second compartment 54 between second flange 32 and inner surface 48 of bonnet 38, separates bonnet 38 into chambers 68 and 70.

Figure 4:
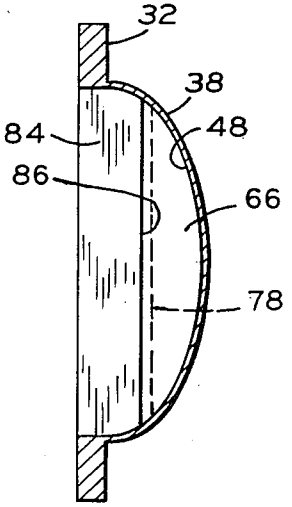
FIG. 4 is a sectional view taken along line 4—4 of FIG. 1 and viewed in the direction of the arrows.
Figure 2:
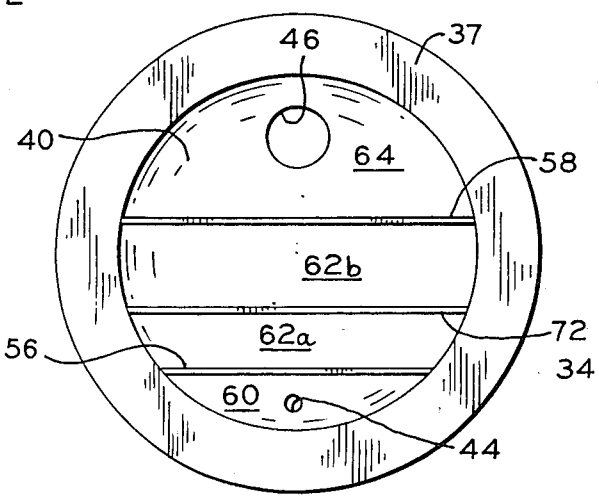
FIG. 2 is a sectional view of the bonnet taken along the line 2—2 in FIG. 1 and viewed in the direction of the arrows.

A secondary baffle 72 with an edge 74 is mounted on and extends from flange 28 generally perpendicular to flange 28 and toward bonnet inner surface 40. Edge 74 and bonnet inner surface 40 cooperate to define a first flow gap 76 therebetween and subchambers **62*a* and 62*b*. Similarly, secondary baffle 78 with outer edge 80 is mounted in chamber 68 and extends from flange 32 to define a second flow gap 82 between bonnet inner surface 48 and edge 80 and to define subchambers 68*a* and 68*b*. A secondary baffle 84 with edge 86 is mounted in chamber 70 on second flange 32 and cooperates with second bonnet inner surface 48 to define a third flow gap 88 therebetween and to define subchambers 70*a*. Primary baffles 56, 58 and 66 and secondary baffles 72, 78 and 84 generally extend across, and appear as chords in cross-section extending across, the circumference of the circular cross-section depicted in FIGS. 2 and 4, and define the chambers and subchambers in the compartments. Baffle plates 56, 58, 66, 72, 78 and 84 may be welded to respective flanges 28 and 32 and the inner surfaces 40 and 48 of bonnets 36 and 38**.

Figure 3:
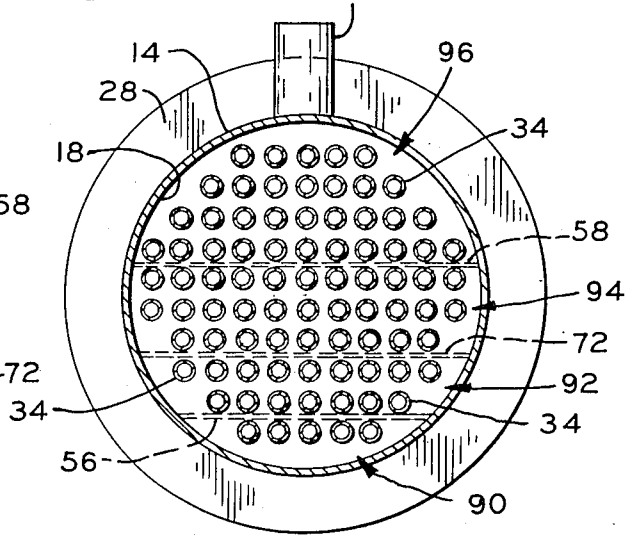
FIG. 3 is a sectional view taken along line 3—3 of FIG. 1 and viewed in the direction of the arrows.

As an example of a tube bundle arrangement, the tubes 34 (FIG. 3) are divided, from bottom to top in the figure, in sequentially increasing numbers of tubes from 5 tubes to 32 tubes per bundle, which illustrates an increasing diametric flow path for the fluid flowing form inlet port 44 to discharge port 46. The tube bundles or tube sets are consecutively numbered 90, 92, 94 and 96 (FIG. 3), and they communicate between first bonnet compartment 52 and second bonnet compartment 54. More specifically, tube bundle 90 communicates between chamber 60, which receives incoming coolant fluid from inlet port 44, and subchamber **66*a*; tube bundle 92 communicates between subchamber 68*b* and subchamber 62*a*; tube bundle 94 communicates between subchamber 62*b* and subchamber 70*a* and tube bundle 96 communicates between subchamber 70*b* and chamber 64 and thus discharge port 46. Thus, the cross-sectional flow area of the sequential tube bundles 90–96 communicating fluid from end-to-end in this sequential arrangement increases between inlet port 44 and discharge port 46. The increasing number of tubes per bundle accommodates the expansion of the fluid transferred between the chambers, where this fluid is being used to cool a treatment liquor introduced through port 22 to shell chamber 20**.

Secondary baffles 72, 78 and 84 in the respective chambers 62, 68 and 70 define the noted fluid flow gaps 76, 82 and 88 in elliptical bonnets 28 and 32. Each of the fluid flow gaps provides a cross-sectional area between the inner bonnet surface and their respective baffle edges 74, 80 and 86 that matches generally the cross-sectional area of the tube bundle that conveys fluid into the chamber. Illustrative of this arrangement, gap 76 in chamber 60 has a cross-sectional area between edge 74 and bonnet inner surface 40, which is approximately equivalent to the total cross-sectional area of the tubes 34 in tube bundle 92 communicating to this cell. Tube bundle 92 was earlier noted as having a cross-sectional area smaller than tube bundle 94. Similarly, the cross-sectional area of gap 82 is approximately equal to the cross-sectional area of tube bundle 90, and the cross-sectional area of gap 88 is approximately equal to the cross-sectional area of tube bundle 94.

In operation, cooling fluid is introduced into the tube bundle network through inlet 44 and is sequentially passed through tube bundles 90, 92, 94 and 96 for discharge from outlet 46 to a recirculating network (not illustrated). As the treatment liquor is introduced through inlet 22 into shell chamber 20, it passes over tubes 34 for cooling and subsequent discharge through discharge outlet 24. As the cooling fluid communicates through the tube bundles 90, 92, 94 and 96, it passes through gaps 82, 76, and 88, in that order as shown in FIG. 1. These gaps present relatively constant cross-sectional flow areas relative to their respective tube bundles, and promote laminar flow between the sequential tube bundles 90, 92, 94 and 96. Thus, the cooling fluid, either liquid or gas, as it flows through the exchanger, does not experience radical pressure drops or back pressures in the head or bonnet chambers and there is better distribution of the fluid through each bundle. Control of the pressure drops and fluid flow characteristics reduces the potential for flashing and other undesirable consequences in the fluid transfer chambers, i.e., maldistribution.

The tubing network and baffle arrangement described above is significantly less expensive, easier to manufacture, assemble and maintain than earlier exchangers as no U-tubes or tortuous channels or passages need to be machined in the bonnets. The technology for the manufacture, such as casting, of these elliptical bonnets or hemispherical heads is known and relatively inexpensive. The tubing network illustrated and discussed above is exemplary and not limiting. The inlet port 44 and exit port 46 may be provided in opposite bonnets and the number of coolant fluid passes in the tubing network is a design choice.

Although the use of secondary baffles 72, 78 and 84 projecting outwardly from flanges 28 and 32 is preferred in that they are simple in construction and inexpensive to manufacture, other baffle shapes could be used. Ideally, the gap provided by the secondary baffles is equal to the cross-sectional area of the tube bundle leading into that particular subchamber. However, the invention is not necessarily so limited in its broadest form, although it does comprehend gaps that generally increase sequentially as the cross-sectional flow areas of the tube bundles increase. The particular refrigerant utilized may be varied depending on the particular application. The refrigerants just mentioned have a relatively low boiling point so that they will change phase from liquid to gaseous as they flow through the heat exchanger 10.

While only a particular embodiment of the invention has been described and claimed herein, it is apparent that various modifications and alterations of the invention may be made. It is therefore the intention in the appended claims to cover all such modifications and alterations as may fall within the true spirit and scope of the invention.

What is claimed is:

1. A heat exchanger comprising:

a shell including a shell wall with an inner surface, a first end and a second end, a shell chamber between said first end and second end, a treatment fluid inlet and a treatment fluid discharge outlet, a first flange and a second flange, mounted at said first end and second end, respectively, each of said first flange and second flange having a bonnet surface and a shell-chamber surface defining an end wall of said shell chamber;

a first flow reversing bonnet mounted on one end of said shell and a second flow reversing bonnet mounted on the other end of said shell, each of said first and second bonnets having a wall with an inner bonnet surface, defining a first bonnet compartment and a second bonnet compartment, respectively;

one of said first and second bonnets including a coolant fluid inlet and one of said first and second bonnets including a coolant fluid discharge outlet;

a plurality of coolant fluid tubes positioned in said shell chamber communicating between said bonnet compartments;

a plurality of primary baffles, at least one of said primary baffles mounted in each of said first and second bonnet compartments between the respective flange and bonnet inner surface, to define at least two fluid transfer chambers in said bonnet compartments;

said tubes being grouped in serially arranged bundles each having a predetermined number of coolant fluid tubes, each of said tube bundles communicating between a fluid transfer chamber in each of said first and second bonnets;

said coolant inlet and outlet, bonnet chambers and tube bundles defining a continuous coolant fluid flow path from said coolant inlet to said discharge port back and forth through said shell and serially arranged tube bundles, said serially-arranged tube bundles providing a successively greater fluid flow cross-sectional area in each sequential tube bundle in the direction of flow from the coolant fluid inlet to the coolant fluid discharge outlet; and secondary baffle means in ones of said chambers where coolant fluid reverses flow direction for defining a restricted flow area for coolant fluid flowing through the respective chamber from one bundle of tubes to the next bundle of tubes, the flow area defined by each baffle means being larger in crosssectional area than the flow area defined by the preceding baffle means.

2. A heat exchanger as claimed in claim 1 wherein each said baffle means extends from a flange toward the respective bonnet inner surface and includes an edge spaced from said bonnet inner surface, the restricted flow area being defined by the gap between the respective baffle means edge and bonnet inner surface.

3. A heat exchanger as claimed in claim 2 wherein each of said gaps has a cross-sectional area substantially equal to the cross-sectional area of the tube bundle leading into the chamber wherein said secondary baffle transfer means is mounted.

4. A heat exchanger as claimed in claim 1 wherein said bonnets are elliptical in shape.

5. A heat exchanger as claimed in claim 1 wherein said bonnet inner surface has an arcuate surface and wherein said primary baffles and secondary baffles define chords across said arcuate surface.

6. A heat exchanger as claimed in claim 1 wherein said tubes include first and second ends sealingly mounted in said first and second flanges.

7. A heat exchanger as claimed in claim 1 wherein said coolant fluid inlet and coolant fluid discharge outlet are on the same bonnet.

8. A heat exchanger comprising:

a shell including a chamber and a plurality of bundles of tubes in said shell chamber extending from one end of said shell to the other end thereof, a first flow reversing bonnet mounted on one end of said shell and a second flow reversing bonnet mounted on the other end of said shell, each of said bonnets having at least one flow reversing chamber in fluid communication with two bundles of tubes, said chambers being serially arranged along the flow path of coolant fluid whereby fluid flows from a bundle of tubes into one chamber, then through another bundle of tubes to the next chamber in the serial arrangement;

secondary baffle means in each of said flow reversing chambers for subdividing the chamber into two subchambers, one subchamber aligned with a bundle of tubes leading into the chamber and the other subchamber aligned with a bundle of tubes leading out of the chamber, said baffle means defining a restricted flow area for coolant fluid flowing from one subchamber to the next subchamber;

the tube bundles aligned with successive subchambers having increasingly larger cross-sectional flow areas;

the cross-sectional restricted flow area defined by the baffle means of each flow reversing chamber being larger than the cross-sectional restricted flow area defined by the baffle means of the preceding flow reversing chamber.

9. The heat exchanger of claim 8 wherein there are at least three said flow reversing chambers each having a said secondary baffle means therein.

10. The heat exchanger of claim 8 wherein each said baffle means comprises an edge spaced inwardly from an inner surface of the respective bonnet to thereby form a gap defining the cross-sectional restricted flow areas.

11. The heat exchanger of claim 10 wherein the restricted flow area defined by a baffle means is substantially equal to the cross-sectional flow area of the upstream tube bundle leading into the respective subchamber formed by that baffle means.

12. The heat exchanger of claim 10 wherein each said baffle means comprises a plate extending axially toward said bonnet means inner surface.

13. The heat exchanger of claim 8 wherein the restricted flow area defined by a said baffle means is substantially equal to the cross-sectional flow area of the upstream tube bundle leading into the respective subchamber formed by that baffle means.

14. The heat exchanger of claim 8 wherein said heat exchanger is of the dry expansion type.

* * * * *